US006138458A

United States Patent [19]

Griffin

[11] Patent Number: 6,138,458

[45] Date of Patent: Oct. 31, 2000

[54] ELECTRO-PNEUMATIC ACTUATOR AND SERVO-VALVE FOR USE THEREWITH

[76] Inventor: William S. Griffin, 1207 8th St., Manhattan Beach, Calif. 90266

[21] Appl. No.: 09/204,336

[22] Filed: Dec. 2, 1998

[51] Int. Cl.[7] ..... F01B 21/04; F01B 25/26

[52] U.S. Cl. ..... 60/716; 92/5 R

[58] Field of Search ..... 91/358 R, 361; 92/5 R; 60/700, 702, 705, 706, 711, 716

[56] References Cited

U.S. PATENT DOCUMENTS

| | | | |
|---|---|---|---|
| 3,934,673 | 1/1976 | Silverman | 181/119 |
| 4,292,949 | 10/1981 | Bendig | 123/556 |
| 4,312,419 | 1/1982 | Noddings | 180/177 |
| 4,510,846 | 4/1985 | Gazzera | 91/358 R X |
| 4,953,578 | 9/1990 | Kautz | 137/14 |
| 4,965,475 | 10/1990 | Kautz | 310/13 |
| 4,967,702 | 11/1990 | Richeson et al. | 91/459 X |
| 5,379,980 | 1/1995 | Houghton, Jr. et al. | 284/550 |
| 5,542,337 | 8/1996 | Baumann | 91/358 X |
| 5,878,571 | 3/1999 | Kleinwachter et al. | 60/520 |
| 6,036,162 | 3/2000 | Hayashi | 248/550 |

*Primary Examiner*—John E. Ryznic
*Attorney, Agent, or Firm*—Colin M. Rauffer; Leonard A. Alkov; Glenn H. Lenzen, Jr.

[57] ABSTRACT

An actuator employing an electromagnetic voice coil actuator in parallel with a pneumatic actuator in a single, integrated unit. Rolling diaphragms on the piston are used to minimize sliding static friction. The pneumatic portion of the actuator provides the high forces necessary to support a heavy load and does not become stiff at high frequencies. At high frequencies (above 15–20 Hz.), where the frequency response of the pneumatic portion of the actuator decreases, the voice coil portion takes over and provides the desired high frequency actuation forces. The voice coil does not require a large amount of electrical power, and air flow in the pneumatic actuator provides sufficient cooling of the voice coil. A servo-valve is also disclosed for use with the pneumatic portion of the electro-pneumatic actuator.

19 Claims, 4 Drawing Sheets

ELECTRO-PNEUMATIC ACTUATOR AND SERVO-VALVE FOR USE THEREWITH

BACKGROUND OF THE INVENTION

1. Field of the Invention

The present invention relates generally to the field of actuators and, more particularly, to an electro-pneumatic actuator having high frequency response and capable of supporting high forces, and a servo-valve for use therewith.

2. Description of Related Art

Actuators are used in mechanical systems to isolate sensitive components from external vibrational forces. Specifically, actuators used in combination with control circuitry employing feed-back or feed-forward loops can dampen the external vibrational forces, thus isolating a load from the source of the vibration. For example, a complex optical structure such as a large telescope or a large laser mounted in an aircraft would be subject to vibrations caused by the aircraft engines and by air turbulence. Such vibrations can adversely affect the operation and longevity of-the optical components. Thus, it is necessary to isolate the optical structure from the vibrations, and such isolation can be accomplished by the use of actuators. Also, actuators having push-pull capabilities (i.e., having operative control in opposite directions) can also be used for steering or direction control, as well as isolation.

The vibrations caused by the aircraft engines are relatively high frequency vibrations on the order of 200–300 Hertz (Hz), whereas the vibrations caused by air turbulence are on the order of 2–5 Hz. When high frequency response is desired, electromagnetic actuators are employed but are generally not suitable for heavy loads, such as large telescopes or laser systems which may weigh up to 10,000 pounds. For use with such heavy loads, hydraulic or pneumatic actuators are preferred, but they perform poorly at high frequencies. For the present example of an optical structure in an aircraft environment, both high frequency response and high forces are required.

Currently, known actuators which can deliver high forces at high frequencies are either hydraulic actuators or very large electromagnetic actuators. Hydraulic actuators suffer from high stiffness at high frequencies, however, which reduces their effectiveness at isolating their payloads. Also, hydraulic actuators tend to leak, making them unsuitable for clean systems applications, such as optical systems in which leaking hydraulic fluid can adversely affect the performance of the optical components.

Large electromagnetic actuators, on the other hand, have high power consumption, especially when supporting heavy loads. In addition, the frequency response suffers if the electromagnetic actuators are designed to support such a large load. Electromagnetic actuators are therefore impractical for the present application.

One solution is to use an electromagnetic actuator in series with a "stiff actuator" such as a ball screw or a hydraulic cylinder. The electromagnetic actuator typically used is a variable reluctance actuator in order to obtain the required forces. However, this type of electromagnetic actuator has low frequency response and high internal inductance. The high inductance limits both the frequency response of the actuator, as well as the forces available at high frequencies due to the large back electromagnetic field (emf) generated by the inductance.

Thus, there is a need for an actuator which combines high frequency response and high force, and which does not become stiff at high frequencies. It is also desirable to have an actuator which has high frequency response and high force, which is not hydraulic.

OBJECTS AND SUMMARY OF THE INVENTION

It is thus an object of the present invention to provide an actuator having both high frequency response and high force, which does not become stiff at high frequencies.

It is another object of the present invention to provide an actuator which is not hydraulic.

It is a third object of the present invention to provide a servo-valve for use with the actuator.

An actuator fulfilling the above objectives comprises a pneumatic actuator means for controlling an output shaft and an electromagnetic actuator means disposed within the pneumatic actuator means for controlling the output shaft, wherein the pneumatic actuator means controls the output shaft for low frequency vibrational forces, and the electromagnetic actuator means controls the output shaft for high frequency vibrational forces. The pneumatic actuator means and the electromagnetic means operate in parallel to control the output shaft, thus providing high forces and high frequency response in one integrated actuator A servo-valve which has a low actuation force, but delivers high flow at high pressure, comprises a flapper valve which is the armature of a torque motor and is restrained by the pressure of the delivered flow. A current source controls the electrical current through the armature coils, to control an air flow.

DESCRIPTION OF THE DRAWINGS

The exact nature of this invention, as well as its objects and advantages, will become readily apparent from consideration of the following specification as illustrated in the accompanying drawings, in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor for carrying out the invention. Various modifications, however, will remain readily apparent to those skilled in the art, since the basic principles of the present invention have been defined herein specifically to provide an electro-pneumatic actuator having a high frequency response and capable of supporting high forces, and a servo-valve for use therewith.

Figure 1:
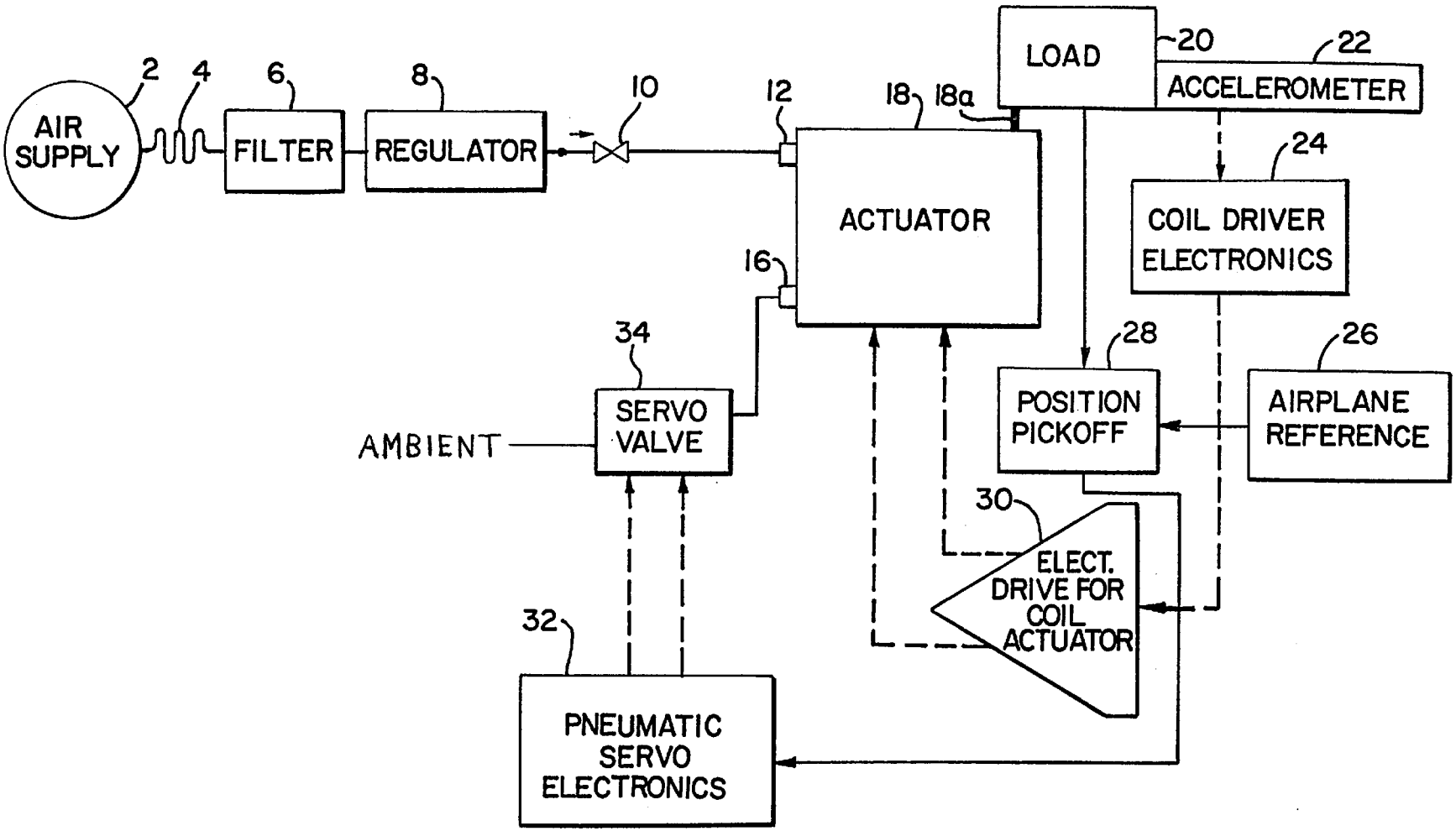
FIG. 1 is a block diagram of a actuator system according to the present invention.

FIG. 1 shows a high-level block diagram of an actuator system utilizing the electro-pneumatic actuator of the present invention. An air supply 2 provides the necessary air for the pneumatic portion of actuator 18. The air from the air supply 2 passes through a heat exchanger 4 to adjust the air temperature as necessary. The air then passes through an air filter 6 and a pressure regulator 8. The air then passes through an upstream orifice 10 for the actuator 18. The air enters the actuator through fitting 12. The air exits the actuator 18 from fitting 16 and enters the servo-valve 34 via the connecting line. The servo-valve 34 serves as a downstream restrictor for this air flow, exhausting it to ambient. As the degree of flow restriction presented by the servo-valve 34 varies, the pressure presented to the actuator 18 will change. This varying pressure is used, in part, by the actuator 18 to support the load 20. The actuator 18 includes both a pneumatic actuator and an electromagnetic actuator which are described in detail below. The actuator 18 supports a load 20 via an output shaft 18a. Attached to the load 20 is an accelerometer 22 to detect vibrations of the load 20. The output of the accelerometer 22 is used as a feed-forward in a servo-loop to cancel out any residual stiffness associated with the actuator 18. The actuator system is a closed loop system at low frequencies so that the actuator 18 stays nominally centered and follows the movement of the aircraft.

A positioning loop which controls the pneumatic portion of the actuator 18 is formed by the position pick-off 28 and airplane reference 26 which provide positioning information to the pneumatic servo electronics 32. The positioning loop is active at low frequencies, but at approximately 5 Hz, the frequency response rolls-off very rapidly (on the order of 40–60 dB/decade) as a result of the feed-forward. Around 5–10 Hz, an acceleration loop is closed in parallel with the positioning loop to drive the electromagnetic portion of actuator 18. The acceleration loop is formed by the accelerometer 22 and the coil driver electronics 24, 30. At high frequencies, the electromagnetic actuator effectively operates at zero acceleration, resulting in a much more "ideal" actuator 18. By means of a high-speed acceleration loop control, which is only available at high frequencies, actuator nonlinearities and friction can be removed. This results in a high degree of isolation of the load 20. A discussion of the low level details of the control loops illustrated in FIG. 1 are beyond the scope of this patent, but such techniques are well known in the relevant arts.

Thus, low frequency response and high force is supplied by the pneumatic portion of the actuator 18, while the electromagnetic portion of the actuator 18 provides high-speed compensation at higher frequencies.

Figure 2:
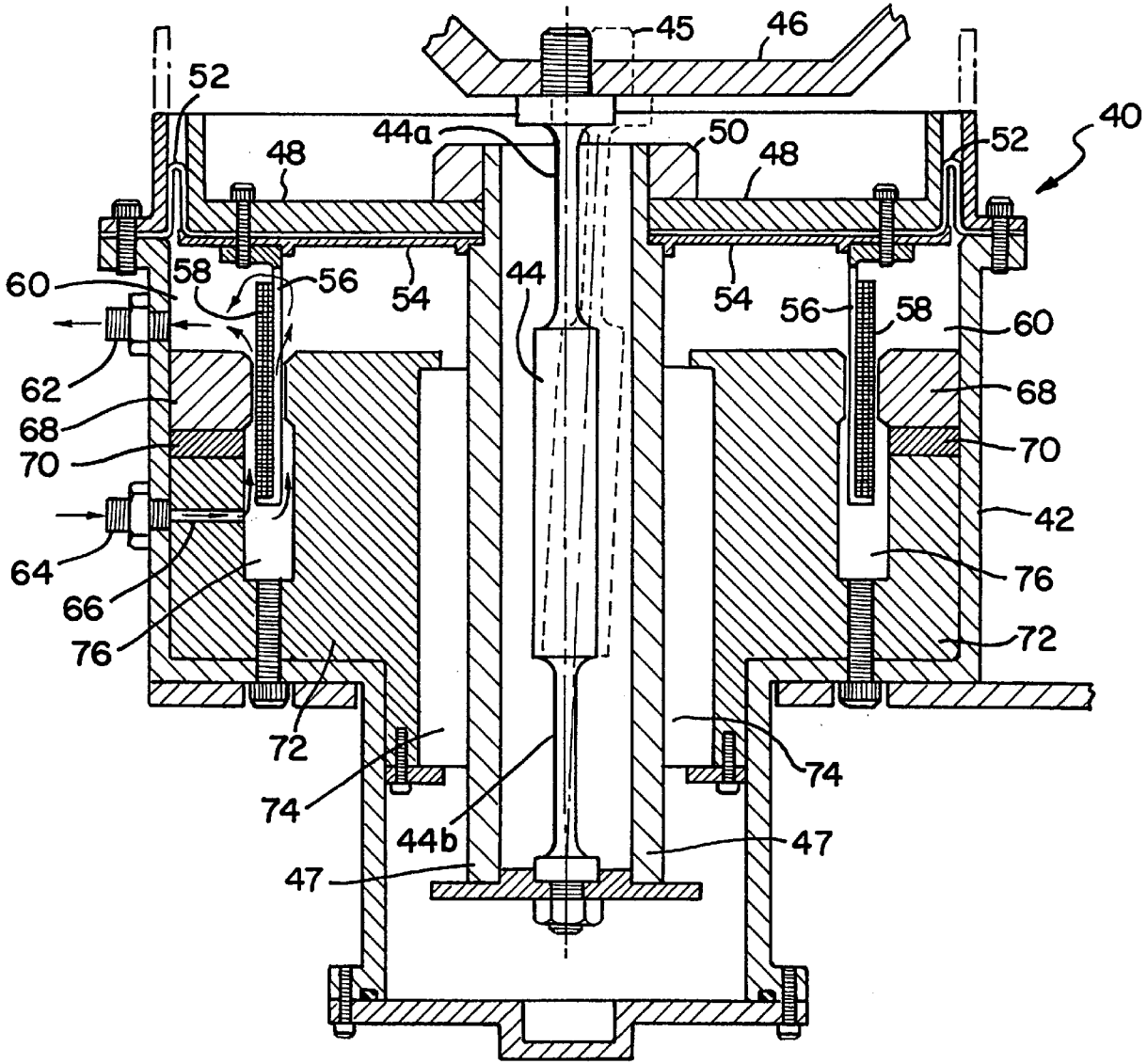
FIG. 2 is a cross-sectional view of a first embodiment of the electro-pneumatic actuator of the present invention specifically suited for isolating a heavy load at both low and high frequencies.

Referring to FIG. 2, a first embodiment of the electro-pneumatic actuator will now be described. FIG. 2 is a cross-sectional view of one embodiment of the electro-pneumatic actuator, wherein the elements are numbered to illustrate common structure in the three-dimensional actuator. An electro-pneumatic actuator 40 has an output shaft 44 which supports a desired load 46, such as an optical structure on board an aircraft (not shown). The output shaft 44 has flexures 44*a*, 44*b* on each end and is generally free to move within a small region as shown by the dashed shaft position 45. The output shaft 44 is enclosed by an output shaft housing 47. A cylindrical linear bearing 74 operatively surrounds the outer surface of the output shaft housing 47. The output shaft 44, output shaft housing 47, and linear bearing 74 are centrally disposed within an actuator enclosure 42.

A back iron 72 is generally cylindrical in shape and is rigidly disposed between the linear bearing 74 and the actuator enclosure 42. As is well known in the art, the back iron 72 and the accompanying actuator structure may be designed in many different shapes, but for the purposes of the description, the back iron 72 and surrounding actuator structure are generally cylindrical. The back iron 72 surrounds the linear bearing 74 and holds it in place within the actuator enclosure 42. The back iron 72 includes a coil opening 76 for receiving a voice coil 58. On an outer edge of the back iron 72, next to the voice coil opening 76, a magnet 70 provides the necessary permanent magnetic force for operation of the electromagnetic actuator portion. The magnet 70 is encased by a secondary back iron 68, in combination with the back iron 72. The back iron 72, magnet 70 and secondary back iron 68 form a generally unitary structure to provide an operative magnetic flux loop for the electromagnetic actuator portion.

A piston 48 attaches to the output shaft housing 47 by means of a nut 50. The piston 48 attaches to the actuator enclosure 42 by means of a rolling diaphragm 52. The rolling diaphragm 52 provides an airtight seal between an air chamber 60 and the piston, while still allowing the piston to move relative to the actuator enclosure 42. A containment plate 54 attaches the rolling diaphragm 52 to the piston 48, ensuring an air-tight seal. The voice coil 58 is wound onto a voice coil bobbin 56. The bobbin 56 is rigidly fastened to the piston 48 and containment plate 54, such that the bobbin 56 moves up and down with the movement of the piston 48. Further, the bobbin 56 is positioned such that it aligns with the coil opening 76 within the back iron structure 72, 70, 68.

An external air supply (not shown) supplies air through an upstream air fitting 64, which corresponds to the air fitting 12 shown in FIG. 1. The path of the air flow is illustrated by arrows in FIG. 2. The air flows through an air passage 60 located in the back iron 72, and into the coil opening 72. The air passes by the voice coil 58 and provides sufficient cooling of the voice coil 58 for proper operation of the actuator 40. The air pressure in the air chamber 60 is controlled by an external downstream servo-valve (as shown in FIG. 1). The operation of a downstream servo-valve is described in further detail below. The air exits the air chamber 60 via an air fitting 62, which is connected via an air line to the external servo-valve. The air fitting 62 corresponds to the fitting 16 shown in FIG. 1.

The air pressure in the chamber 60, as controlled by the servo loop illustrated in FIG. 1, raises and lowers the piston as necessary. As the air pressure is decreases, the force of the load 46 on the output shaft 44 forces the piston down. As the air pressure is increased, the piston 48 is forced up, raising the output shaft 44. This pneumatic actuator portion provides for high forces and low frequency compensation.

At high frequencies, above 5–10 Hz in this example, the electro-magnetic actuator portion controls the movement of the piston 48. The external electromagnetic actuator controls, illustrated in FIG. 1, provide electrical signals to the voice coil 58. The actual electrical connections are not shown in FIG. 2 for clarity, but may be made by any suitable means well known in the art. Depending upon the polarization of the current flowing through the voice coil 58, the voice coil 58 exerts a force substantially parallel to its axis and either up or down as shown in FIG. 2. This force is generated by interaction of the current flowing in the voice coil's 58 windings with the substantially radial magnetic flux created across the voice coil 58 by the magnet 70 and back iron structure 68, 72. Since the voice coil current can be modulated at high speeds, the electromagnetic actuator portion provides for high frequency compensation for vibrational forces affecting the load 46. Since the pneumatic actuator portion is still providing low frequency compensation, the electromagnetic actuator portion does not need to be able to support the entire load 46. In fact, the electromagnetic actuator portion only needs to be able to support approximately 5% of the load 46 for a 1 G environment. Thus, the combination of the pneumatic actuator portion and the electromagnetic actuator in a single housing, operatively controlling a common output shaft, provides both high forces and high frequency compensation.

Figure 3:
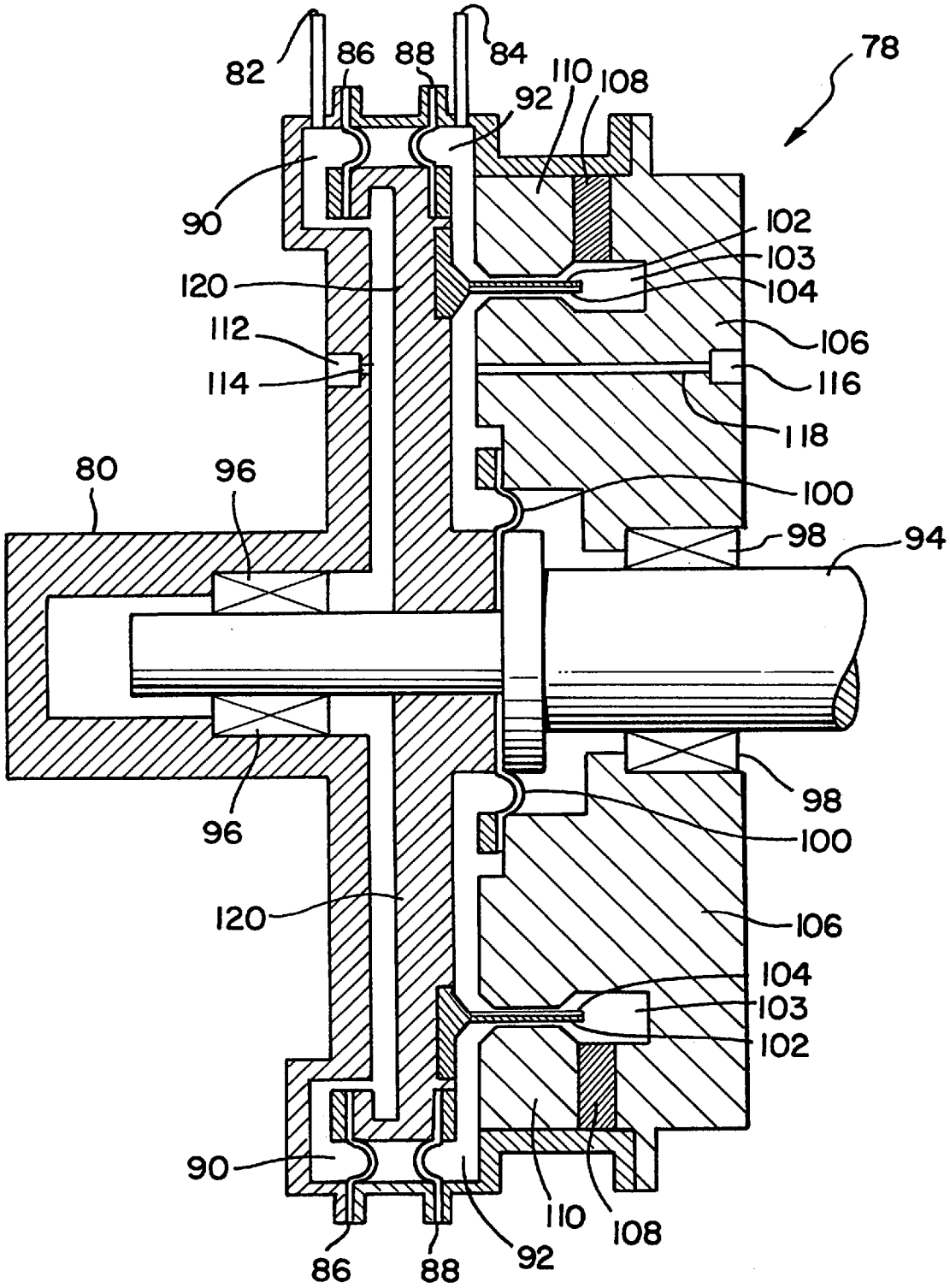
FIG. 3 is a cross-sectional view of a second embodiment of the elector-pneumatic actuator of the present invention having a push-pull feature for controlling a direction of a load.

A second embodiment of the present invention is shown in FIG. 3. This embodiment has a "push-pull" configuration which provides for fine steering or direction control, as well as isolation. The electro-pneumatic actuator 78 is illustrated in a cross-sectional view, with the elements numbered to show common structure. An output shaft 94 is centrally disposed within an actuator enclosure 80. Two linear bearings 96, 983 provide for smooth axial movement of the output shaft 94. A piston 120 connects to the output shaft 94 between the linear bearings 96, 98. The piston 120 has an air chamber 90, 92 on both sides which are used to control the pneumatic portion of the actuator 78. A rolling diaphragm 100 provides an air-tight seal between the piston 120 and the output shaft 94. Note that the rolling diaphragm 100 is necessary to seal the upper air chamber 92, but that the lower air chamber 90 is sealed by the actuator enclosure 80. Two additional rolling diaphragms 86, 88 separate the upper air chamber 92 from the lower air chamber 90. The piston 120 and output shaft 94 thus are free to move as guided by the linear bearings 96, 98, depending on the relative air pressures in the air chambers 90, 92.

Air enters the lower air chamber 90 through an upstream orifice 112 which connects to the lower air chamber 90 through an air channel 114 in the actuator enclosure 80. Similarly, air enters the upper air chamber 92 through an upstream orifice 116 which connects to the upper air chamber 92 through a second air channel 118. The air pressure in the air chambers is controlled by a downstream servo-valve (not shown) connected to the air tubes 82, 84. The servo-valve controls the relative air pressures in the upper and lower air chambers 92, 90 as directed by the external control circuitry illustrated in FIG. 1 and in a manner described previously for the single sided actuator of FIG. 2.

The electromagnetic portion of actuator 78 will now be described. A generally cylindrical voice coil bobbin 104 is attached to the piston 120 on the upper air chamber 92 side. A voice coil 102 is wound onto the voice coil bobbin 104. A generally cylindrical back iron 106 is disposed between the output shaft 94 and the actuator enclosure 80, the back iron 106 may be formed using other desired shapes as noted above, however. The back iron 106 contains a voice coil opening 103 for receiving the voice coil 102 and bobbin 104. The voice coil bobbin 104 is positioned to align with the voice coil opening 103 in the back iron 106. A magnet 108 is disposed on an outer edge of the back iron 106, next to the voice coil opening 103, to provide the necessary permanent magnetic force to operate the electromagnetic actuator portion. The magnet 108 is encased by a second cylindrical back iron 110 The air entering into the lower air chamber 90 through the upstream orifice 116 passes by the voice coil 102 as the air exits through the air tube 84. This air flow provides the necessary cooling of the voice coil for proper operation of the actuator 78.

The external electromagnetic actuator controls, illustrated in FIG. 1, provide electrical current to the voice coil 102 through electrical connections (not shown). Depending upon the electrical current provided, the voice coil 102 exerts a farce substantially aligned with its axis and to either the left or the right in FIG. 3, depending on the polarity of the current flowing in the voice coil 102 windings. This force is generated as a result of interactions between the voice coil's 102 current and the substantially radial magnetic flux through it which is created by the magnet 108 and its associated back iron structure 106, 110. Due to this force, the voice coil 102 moves the piston 120, which in turn controls the output shaft 94. Since the electrical current can be modulated quickly, high frequency compensation can be obtained. Furthermore, since the pneumatic portion operates in a bidirectional fashion, a heavy load can be steered or controlled by the actuator 78, given appropriate commands to the downstream servo-valve.

Figure 4:
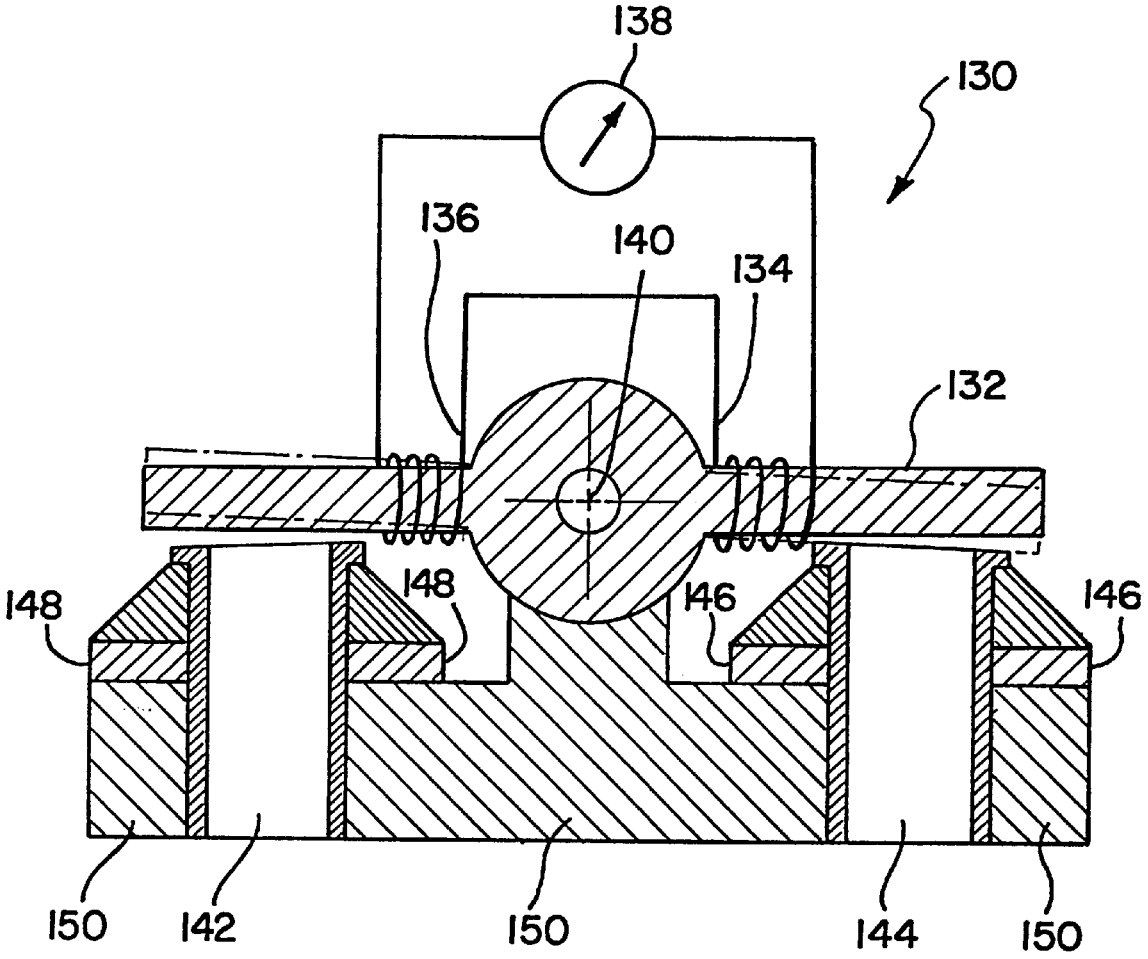
FIG. 4 is a cross-sectional view of a servo-valve uniquely suited for use with the electro-pneumatic actuator of the present invention.

In order to properly operate the pneumatic portion of the above described actuator, a pneumatic servo-valve is required. The pneumatic servo-valve would ideally require low electrical drive signals but create high pressure accompanied by moderate flows. FIG. 4 illustrates a unique servo-valve 130 having these characteristics. A flapper valve 132 is the armature of a torque motor. Electrical coils 134, 136 are wound around the flapper valve armature 132 and an electrical current is provided by a current source 138. Permanent magnets 146, 148 in combination with a back iron structure 150 and the flapper valve armature 132 develop two magnetic flux loops. In the embodiment shown, the magnets are oriented such that magnetic North is up and South is down. However, the reverse orientation may be used with equal efficiency. The flapper valve 132 pivots at a central point 140 and may be restrained by a torsional spring (not shown). Metering orifices 142, 144 have slightly beveled tops so that the flapper valve 132 can completely seal off the metering orifices 142, 144, even though the valve 132 is pivoting down slightly. As one orifice 142, 144 is opened, more air escapes, thus reducing the air pressure in the associated air chamber in an attached actuator. Due to the pivoting nature of the flapper valve armature 132, the opposite metering orifice 142, 144 closes thus raising its pressure.

In addition to its pivot, the flapper valve 132 is restrained by the pressure of the delivered flow. The servo-valve 130 is thus a force balance mechanism which delivers output pressure which is a function of input drive current 138, and is therefore a current controlled pressure regulator. With this type of servo-valve, the normal large time constant associated with charging the internal volume of pneumatic actuators is circumvented for moderate to small amplitude signals. This allows the actuator/servo-valve combination to have a considerably higher frequency response.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. An actuator apparatus for isolating a load comprising:

a pneumatic actuator means for controlling an output shaft;

an electromagnetic actuator means disposed within the pneumatic actuator for controlling the output shaft, wherein the pneumatic actuator means controls the output shaft for low frequency vibrational forces, and the electromagnetic actuator controls the output shaft for high frequency vibrational forces, and an actuator enclosure, wherein the pneumatic actuator and the electromagnetic actuator are disposed within the actuator enclosure and the output shaft is centrally disposed within the actuator enclosure.

2. The actuator apparatus of claim 1, wherein the pneumatic actuator means comprises:

a piston connected to the output shaft, the piston having a first side and a second side;

a first linear bearing encircling the output shaft;

a first air chamber positioned between the first side of the piston and the actuator enclosure;

a first rolling diaphragm connected to the actuator enclosure and to the first side of the piston, wherein the first rolling diaphragm provides an air-tight seal for the first air chamber;

a first pneumatic input connected to the first air chamber; and a first pneumatic output connected to the first air chamber.

3. The actuator apparatus of claim 2, wherein the electromagnetic actuator means comprises:

a coil bobbin fastened to the first side of the piston;

a voice coil wound around and supported by the coil bobbin within the first air chamber, the voice coil connected to control circuitry;

a first back iron disposed between the first linear bearing and the actuator enclosure, the first back iron having a coil opening for receiving the voice coil and bobbin;

a magnet disposed on an outer edge of the first back iron, between the actuator enclosure and the voice coil; and a second back iron disposed on top of the magnet, between the actuator enclosure and the voice coil.

4. The actuator apparatus of claim 3, wherein the first pneumatic input comprises:

a first air supply fitting on the enclosure; and a first air flow channel within the first back iron connecting the air supply fitting with the first air chamber.

5. The actuator apparatus of claim 4 further comprising a containment plate attached to the piston, wherein the first rolling diaphragm is disposed between the piston and the containment plate to provide an air-tight seal.

6. The actuator apparatus of claim 2, further comprising:

a second air chamber located on the second side of the piston;

a second rolling diaphragm disposed between the piston and the actuator enclosure to separate the first and second air chambers;

a second pneumatic input; and a second pneumatic output attached to the actuator enclosure at a point external to the second air chamber, the second pneumatic output connected to a servo-valve.

7. The actuator apparatus of claim 6, further comprising:

a third rolling diaphragm disposed between the second air chamber and the output shaft; and a second linear bearing disposed around the output shaft.

8. The actuator apparatus of claim 7, wherein the electromagnetic actuator means comprises:

a coil bobbin fastened to the second side of the piston;

a voice coil wound around and supported by the coil bobbin within the second air chamber, the voice coil connected to control circuitry;

a first back iron disposed between the first linear bearing and the actuator enclosure, the first back iron having a coil opening for receiving the voice coil and bobbin;

a magnet disposed on an outer edge of the first back iron, between the actuator enclosure and the voice coil; and a second back iron disposed on top of the magnet, between the actuator enclosure and the voice coil.

9. An actuator system for isolating a load mounted in an aircraft from vibrational forces, the actuator system comprising:

a low frequency pneumatic actuator having an output shaft for supporting the load;

a high frequency electromagnetic actuator disposed within the pneumatic actuator and connected to the output shaft, wherein the low frequency pneumatic actuator controls the output shaft at low frequencies and the high frequency electromagnetic actuator controls the output shaft at high frequencies;

pneumatic actuator control means for controlling the pneumatic actuator; and electromagnetic actuator control means for controlling the electromagnetic actuator.

10. The actuator system of claim 9, further comprising:

an air supply for supplying air to the pneumatic actuator;

an air filter for filtering the air from the air supply; and a regulator for regulating the pressure of the air.

11. The actuator system of claim 10, further comprising:

a pneumatic input connected to the pneumatic actuator;

an upstream orifice for the pneumatic actuator connected between the regulator and the pneumatic input;

a downstream servo-valve for controlling the air pressure in the pneumatic actuator; and a pneumatic output connecting the pneumatic actuator with the downstream servo-valve.

12. The actuator system of claim 11, further comprising:

an accelerometer connected to the load, the accelerometer providing an acceleration output signal;

a reference position indicator for determining a reference position; and a position pick-off for determining a position of the load relative to the reference position;

wherein the pneumatic actuator control means controls the servo-valve based on the position of the load determined by the position pick-off, and wherein the electromagnetic control means controls the electromagnetic actuator based on the acceleration output signal.

13. The actuator system of claim 12, wherein the pneumatic actuator control means controls the pneumatic actuator for low frequency vibrations below 5 Hertz.

14. The actuator system of claim 13, wherein the electromagnetic actuator control means controls the electromagnetic actuator for vibrations having frequencies between 5 and 300 Hertz.

15. An electro-pneumatic actuator comprising:

an actuator enclosure;

an output shaft centrally disposed within the actuator enclosure and exiting a first end of the actuator enclosure;

a piston connected to the output shaft at the first end of the actuator enclosure;

a first rolling diaphragm disposed between the piston and the actuator enclosure;

a coil bobbin fastened to the piston;

a voice coil wound around and supported by the coil bobbin, the voice coil connected to control circuitry;

a linear bearing encircling the output shaft;

a first back iron disposed between the linear bearing and the actuator enclosure, the first back iron having a coil opening for receiving the voice coil and bobbin;

a magnet disposed on an outer edge of the first back iron, between the actuator enclosure and the voice coil;

a second back iron disposed on top of the magnet, between the actuator enclosure and the voice coil;

a first air chamber positioned between the piston and the first and second back irons, such that the first air chamber extends into the coil opening in the first back iron;

a first pneumatic input comprising:

a first air supply fitting on the enclosure; and a first air flow channel within the first back iron connecting the air supply fitting with the first air chamber; and a first pneumatic output attached to the actuator enclosure at a point external to the first air chamber, such that air flows from the first air flow channel by the voice coil and out the first pneumatic output, the first pneumatic output connected to a servo-valve.

16. The electro-pneumatic actuator of claim 15 further comprising a containment plate attached to the piston, such that the rolling diaphragm is disposed between the piston and the containment plate to provide an air-tight seal.

17. The electro-pneumatic actuator of claim 15, further comprising:

a second air chamber located on an opposite side of the piston from the first air chamber;

a second rolling diaphragm disposed between the piston and the actuator enclosure to separate the first and second air chambers;

a second pneumatic input comprising:

a second air supply fitting on the enclosure;

a second air flow channel within the actuator enclosure connecting the second air supply fitting with the second air chamber; and a second pneumatic output attached to the actuator enclosure at a point external to the second air chamber, the second pneumatic output connected to a servo-valve.

18. The electro-pneumatic actuator of claim 17, further comprising:

a third rolling diaphragm disposed between the first and second air chambers, generally parallel to the second rolling diaphragm; and a second linear bearing disposed around the output shaft.

19. The electro-pneumatic actuator of claim 18, wherein pneumatic air flow cools the voice coil.

* * * * *